United States Patent [19]

Shaw

[11] 4,319,461

[45] Mar. 16, 1982

[54] METHOD OF AIR CONDITIONING

[75] Inventor: Allan Shaw, Adelaide, Australia

[73] Assignee: University of Adelaide, Adelaide, Australia; a part interest

[21] Appl. No.: 101,256

[22] Filed: Dec. 18, 1979

[30] Foreign Application Priority Data

Mar. 28, 1979 [AU] Australia ..... PD8226

[51] Int. Cl.[3] ..... F25D 17/06

[52] U.S. Cl. ..... 62/93

[58] Field of Search ..... 62/93, 89

[56] References Cited

U.S. PATENT DOCUMENTS 3,304,696 2/1967 McKenna ..... 62/93

*Primary Examiner*—Ronald C. Capossela

*Attorney, Agent, or Firm*—Jay L. Chaskin

[57] ABSTRACT

An air conditioning method wherein supply air is introduced into an air conditioned space to maintain a condition of temperature and humidity of air within that space. The invention is characterized in that the air is passed over the cold coil of a dehumidifier both with a low face velocity and a low Reynolds number, resulting in the coil condition curve being compatible with the load ratio line and in turn achieving an energy saving.

This invention relates to a method of air conditioning and has as its main object the conservation of energy as well as the improvement of air conditioning system performance.

5 Claims, 6 Drawing Figures

A FAMILY OF CURVES FOR A PARTICULAR DEHUMIDIFIER.

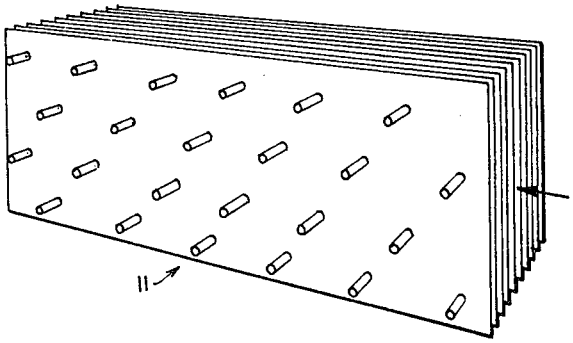
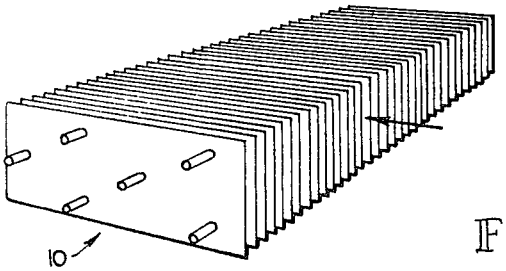
Fig 4
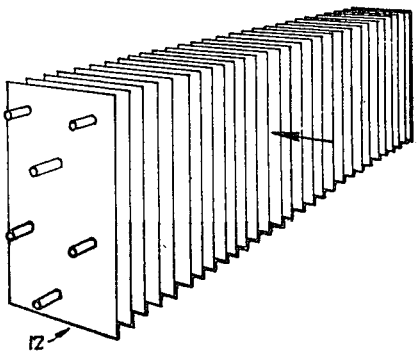

METHOD OF AIR CONDITIONING

BACKGROUND OF THE INVENTION

In air conditioning a space, a major objective is to establish a design temperature and humidity for that space. Although usually the design condition will vary over a small tolerance range, sometimes the design conditions are determined by the requirements of mechanical, electrical or electronic equipment, for example, a photographic laboratory or an operating theatre in a hospital.

To maintain design conditions, maximum sensible and latent heat loads are determined, and a supply of air, usually partly recirculated and partly fresh, is passed over a relatively cold heat exchanger surface of a dehumidifier, where it is cooled and moisture is condensed in order to offset the sensible and latent heat loads.

Removal of humidity (latent heat) from air by chemical means is already known and this forms no part of the invention. For many reasons dehumidification by passing air over a low temperature extended heat exchange surface is preferred, but throughout the full range of air inlet temperature from 4° C. to 45° C. and the outlet temperature from −2° C. to 44° C., and the range of inlet moisture content from 0.004 to 0.022 and the outlet humidity ratio from 0.004 to 0.021 (kg. of moisture per kg of dry air), effective air conditioning has not been achieved without (in many instances) overcooling the air in order to offset the humidity load. This is because under present practice it has not been practicable to obtain from the air conditioning system a performance which achieves one of the major aims of an air conditioning system, that is a coil condition curve which is compatible with the load ratio line. In the methods which have been adopted heretofore it is necessary (in many instances) to overcool to sufficiently dehumidify the air to offset the latent heat loads, resulting in the outlet end of the coil condition curve being at a dry bulb temperature which is less than the required temperature at the inlet condition of the load ratio line. When overcooling occurs, reheating is frequently required to rectify these conditions. Since the coefficient of performance of an air conditioner is usually greater than unity (sometimes as much as five), the energy consumed in reheating can be a large proportion of the total energy consumed by the system.

Historically, the factors governing air conditioning system design have been built on numerous approximations some of which are well founded although their effect is minor, and others have resulted in over design, waste of energy and poor performance. However, an important factor in an air conditioning system is its heat exchanger (or dehumidifier) which functions to both cool and dehumidify air in order to reduce both the sensible and latent heat of the air being cooled (that is, the specific enthalpy).

By making reference to early practice, it is possible to observe the effects of the invention. Early practice has mis-interpreted the statement that "the higher the air velocity, the higher the bypass factor". Though this as an isolated statement can be shown to be true, it is not true when qualified by the constraints that are imposed by the principles of air conditioning in system design. Taken in total complex of an air conditioning system design, it is shown hereunder that the opposite is true.

The term "bypass factor", and another approximate term used synonomously with bypass factor (because they are nearly equal), "wet bulb depression ratio", relate in the context of this specification, to describe per unit mass of flow of dry air, that is, the degree of dehumidification relative to sensible cooling that will be expected. A high bypass factor (or a high wet bulb depression ratio), under the constraints that apply to air conditioning problems, is associated with a low face velocity. The statement, "the higher the air velocity, the higher the bypass factor", fails to apply to the air conditioning system situation because the higher air velocity of necessity requires a dehumidifier to have a smaller face and free flow area in order to maintain the desired mass flow rate of air that is relevant to an air conditioning system requirement, and to the associated temperature difference across the dehumidifier. The air conditioning application requires qualifications to the statement. To reduce the face area would reduce the size of the dehumidifier. Even though high velocities are associated with improved total heat exchange performance, there would be insufficient heat exchange surface unless the dehumidifier makes up part of the loss of size in face area by some increase in depth, or in a change of design of coil, such as increased number of fins per unit length. This is due to the constraint that dehumidifiers in an air conditioning application must be selected for a particular mass flow rate (or volume flow rate) of air, and a deeper dehumidifier, due to the higher face velocity, will have a reduced bypass factor (not an increased bypass factor). This is established by the equation:

$$\text{Bypass factor} = (\text{Bypass factor per one row deep})^n$$

where n represents the rows in depth.

Since the bypass factor is a number less than 1 and n is a positive exponent, the bypass factor will reduce on increase of rows in depth of a dehumidifier.

The effect of even a minor increase in depth is far greater than an increase in air velocity. Thus in the context of air conditioning application an increase in air face velocity will reduce the bypass factor.

The following example illustrates the very important and opposite conclusion when applied to an air conditioning system having a fixed mass flow of air:

Reference is made to the third edition of the authoritative textbook "Modern Air Conditioning, Heating and Ventilating" by Carrier, W. H.; Cherne, R. E.; Grant W. A. and Roberts, W. H., published by Pittman Publishing Co., New York, U.S.A. On page 319, the following statement appears:

"The bypass factor decreases . . . as air velocity decreases".

The following table is also found on that page:

TABLE 1

TYPICAL BYPASS FACTORS FOR COOLING SURFACE (⅝ in. OD tube, 8 crimped helical fins per inch, 0.008 in. thick, 13/32 in. fin height, surface ratio 12.3)

| Rows Deep | Face velocity (fpm) 300 | 400 | 500 | 600 |
|---|---|---|---|---|
| | Bypass factor | | | |
| 1 | 0.61 | 0.63 | 0.65 | 0.67 |
| 2 | 0.38 | 0.40 | 0.42 | 0.43 |
| 3 | 0.23 | 0.25 | 0.27 | 0.29 |
| 4 | 0.14 | 0.16 | 0.18 | 0.20 |
| 5 | 0.09 | 0.10 | 0.11 | 0.12 |
| 6 | 0.05 | 0.06 | 0.07 | 0.08 |
| 7 | 0.03 | 0.04 | 0.05 | 0.06 |
| 8 | 0.02 | 0.02 | 0.03 | 0.04 |

TABLE 1-continued

| TYPICAL BYPASS FACTORS FOR COOLING SURFACE | | | | |
|---|---|---|---|---|
| (⅝ in. OD tube, 14.4 smooth helical fins per inch, 0.012 in. thick at base, 13/32 in. fin height, surface ratio 21.5) | | | | |
| 1 | 0.48 | 0.52 | 0.56 | 0.59 |
| 2 | 0.23 | 0.27 | 0.31 | 0.35 |
| 3 | 0.11 | 0.14 | 0.18 | 0.20 |
| 4 | 0.05 | 0.07 | 0.10 | 0.12 |
| 5 | 0.03 | 0.04 | 0.06 | 0.07 |
| 6 | 0.01 | 0.02 | 0.03 | 0.04 |

Contrary to the teaching of that textbook, this invention is based partly on the discovery that the bypass factor increases as air velocity decreases when the constraints imposed by an air conditioning system are imposed.

The Table above indicates that a four row deep coil with a 600 foot per minute face velocity has a bypass factor of 0.20 and the same coil at 300 feet per minute face velocity has a lower bypass factor of 0.14. The above comparison however is involving two mass flow (or volume flow) terms. In the context of selection for an air conditioning system, two different unrelated problems are being compared since a designer must select a dehumidifier based on a particular mass flow of air that fits the problem which in turn is associated with a particular temperature difference across the load ratio line.

For a fixed mass flow of air, the 600 fpm coil should have half the face area in order to maintain the comparison of the same mass flow of air. In such a comparison even though the higher velocity coil would have a greater capacity for heat transfer it would be necessary to use a deeper dehumidifier. It it is desired to compare the two coils under the conditions that they have equal total heat exchange surface then the halved 600 feet per minute face area dehumidifier would have twice the depth or 8 rows. It is known that the bypass factor reduces with coil depth. It is shown herein that the rate of increase of bypass factor with increase of air velocity is small in relation to the decrease resulting from the increase of coil depth.

If Table 1 is studied to observe the relative effect, it will be seen that a 4 row deep coil at 300 feet per minute will have a bypass factor of 0.14, and at 600 feet per minute a bypass factor of 0.20. However, when considered under conditions of equal air flow rates by adjusting the face area and depth of the coil, a 5 row deep coil, at 600 feet per minute will have a bypass factor of 0.12, but with 8 rows deep, 0.04.

Thus it is seen that a lower velocity coil under conditions of constant mass flow rate (as in the case of an air conditioning application) will have the larger bypass factor. For example as shown above, 0.14 compared with 0.12 and 0.04. (For sake of complying with the Table referred to, the above are imperial units).

The main object of this invention is to provide a method of air conditioning wherein the energy requirement of the system is reduced, and a second related object is to reduce the required size of the machinery and cooling tower (even though these benefits may be gained to some extent at the expense of a larger dehumidifier cross-section).

BRIEF SUMMARY OF THE INVENTION

Briefly in this invention, supply air is introduced into an air conditioned space in sufficient quantity to offset sensible and latent heat loads. The supply air is passed over a heat exchanger surface of a dehumidifier at very low speeds (and consequently has a very low Reynolds number). Contrary to expectation, this results in the coil condition curve being selected at that low velocity which is compatible with the load ratio line, and in almost all instances, the need to reheat is avoided.

More specifically, the invention consists of a method of conditioning air in a space to maintain a condition of temperature and humidity of the air within a design range by removal of sensible and latent heat from supply air and introducing sufficient supply air into said space to maintain said condition, said method comprising passing said supply air over a relatively cold heat exchanger surface of a dehumidifier at such velocity that the face velocity of the air at entry to the dehumidifier is between 0.4 and 2 meters per second, and the maximum Reynolds number (as described herein) of the air during its passage over the heat exchanger surface is proportionally reduced (as described herein) between 100 and 2000.

BRIEF DESCRIPTION OF THE DRAWINGS

The invention is described hereunder in further detail with reference to certain examples which are illustrated in the accompanying drawings, in which:

FIG. 4 shows three ways of using a single dehumidifier.

DETAILED DESCRIPTION OF EMBODIMENTS OF THE INVENTION

Figure 1:
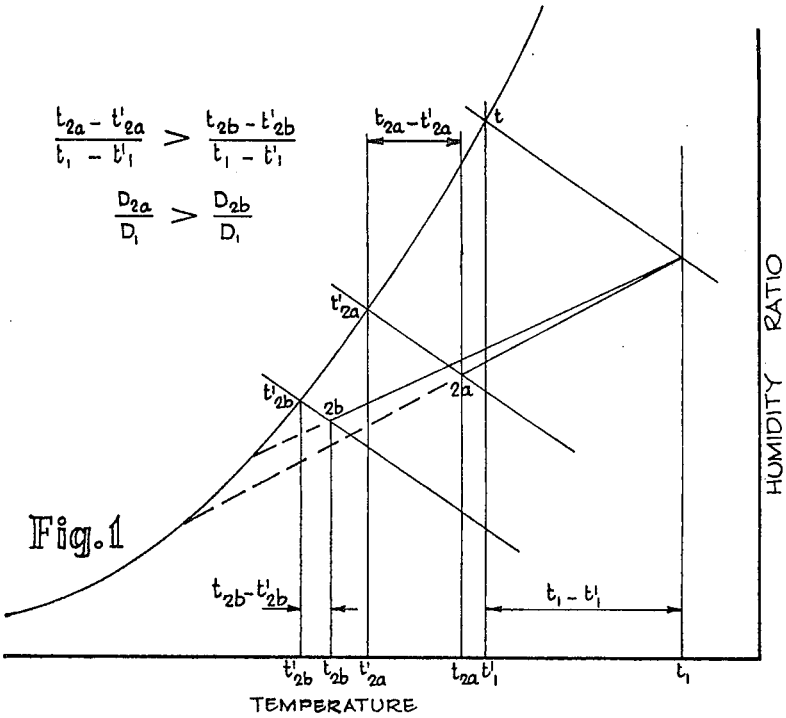
FIG. 1 illustrates a simplified psychrometric representation of two coil condition curves having differences of slope, this representation being according to the early bypass method of coil selection.

In the embodiments described hereunder it will be shown that a lower velocity air flow through a coil, having the larger bypass factor has the steeper coil condition curve on the psychrometric chart. It will dehumidify in relation to sensible cooling at a greater rate than the higher velocity coil. This is illustrated in FIG. 1, using the approximately equivalent term "Wet Bulb Depression Ratio", earlier used by manufacturers of dehumidifiers. Using a simplified industrial approach (which has been used in the past), and which assumes the coil condition curve is a straight line, the performance of 2 coils are compared in FIG. 1 under the following conditions:

(i) Same total length of primary tubing
(ii) Same secondary fin to primary surface configuration
(iii) Same quantity of heat exchange surfaces
(iv) Same mass flow of air.

Both coils operate:

(v) with the same inlet specific enthalpy, dry bulb temperature and humidity ratio However, coil (a) has:

(vi) twice the face area but half the number of rows in depth of the other coil.

The two coil condition curves representing these coils having the same entry condition are illustrated on a psychrometric chart in FIG. 1. The object is to determine the relationship between Coil Condition Curve Slope and Wet Bulb Depression Ratio (Bypass Factor).

The relevant equations for wet bulb depression ratios are:

$$\frac{D_{2a}}{D_1} = \frac{t_{2a} - t_{2a}^1}{t_1 - t_1^1}$$

for the steeper coil condition curve and this is greater than $$\frac{D_{2b}}{D_1} = \frac{t_{2b} - t_{2b}^1}{t_1 - t_1^1}$$

for the shallower curve, where t=dry bulb temperature, t'=wet bulb temperature, and D=the Depression Ratio (bypass factor).

It can be seen that the denominators, entering wet bulb depression $D_1$, in the expression for the two coil load ratio lines, are equal. The numerators of the leaving wet bulb depression are greater for the coil load ratio line with the steeper slope. This demonstrates that coil (a) with the steeper slope will have the larger depression ratio (and the larger bypass factor) under the conditions of comparison described above.

It is therefore possible to determine from wet bulb depression ratio (bypass factor), data on coils the arrangement which will be preferred to offset latent heat loads. It should be noted that the outlet condition *2a*, for the coil with the steeper coil condition curve is at a higher wet bulb temperature than the outlet for the shallower coil condition curve *2b*. This was done to anticipate what actually does occur due to reduced enthalpy change occurring with lower air velocities. However, it should be noted that, had the outlet condition of the steeper coil condition curve been at the same wet bulb temperature as the shallower coil, the same conclusion would have been drawn. The coil with the steeper coil condition curve would continue to have the larger wet bulb depression ratio.

Thus the steeper coil condition curve has been shown to be associated with the larger wet bulb depression ratio (bypass factor). It has also been shown that in the context of air conditioning system constraints, high bypass factors (wet bulb depression ratios) are associated with lower air velocities.

Although the above has been determined using an historical simplistic and approximate approach, it can nevertheless be concluded that under conditions of comparison which have been enumerated above, which are applicable to air conditioning system applications, steeper coil condition curves are associated with lower face velocities of air.

Figure 2:
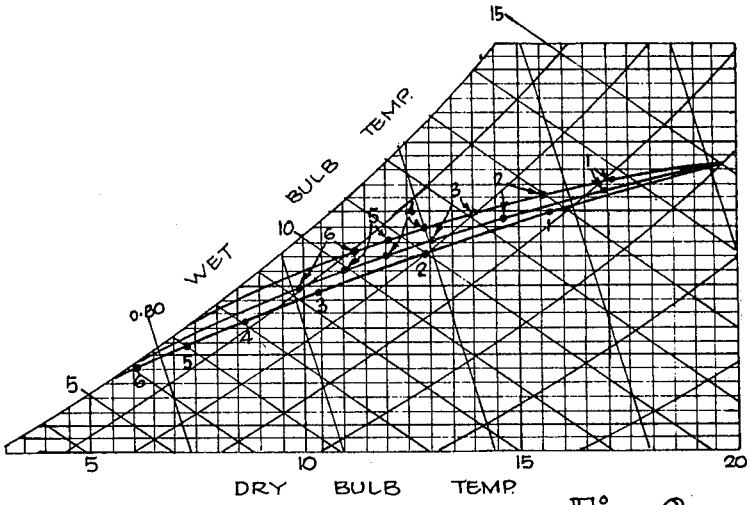
FIG. 2 is a family of curves for three different dehumidifier configurations.

This conclusion is more exactly illustrated in FIG. 2, which is developed using heat mass transfer and enthalpy potential theory. Here a "family of curves" are drawn on portion of a psychrometric chart. The curves compare the same mass of dry air moving at different face velocities through dehumidifier coils.

The upper curve is for the highest face velocity and has the shallowest slope, the middle curve the medium face velocity and has the medium slope and the lowest curve has the lowest face velocity and has the greatest slope. Each curve is numbered indicating performance of the dehumidifier for 2 to 6 rows of depth. For the same leaving enthalpy (that is, leaving wet bulb temperature) it can be clearly seen that the rows of depth are least for the lowest face velocity coil and most for the highest face velocity coil. The bypass factor would be under the same leaving enthalpy condition, least for the highest velocity coil, and greatest for the lowest face velocity coil.

Although for the sake of simplicity, the early, straight line, bypass method has been used to demonstrate the effect of velocity on dehumidifiers, no matter how advanced the method of coil selection, this minimum limitation to face velocity constrains the system to deeper coils where the coil condition curve fails to have the capacity to sufficiently dehumidify to offset the latent heat loads at two meters per second.

Another example will be given illustrating that existing practice has failed to employ the principles of air velocity (and Reynolds number) in application to the simultaneous processes of cooling and dehumidifying that take place in an air conditioning system.

Figure 3:
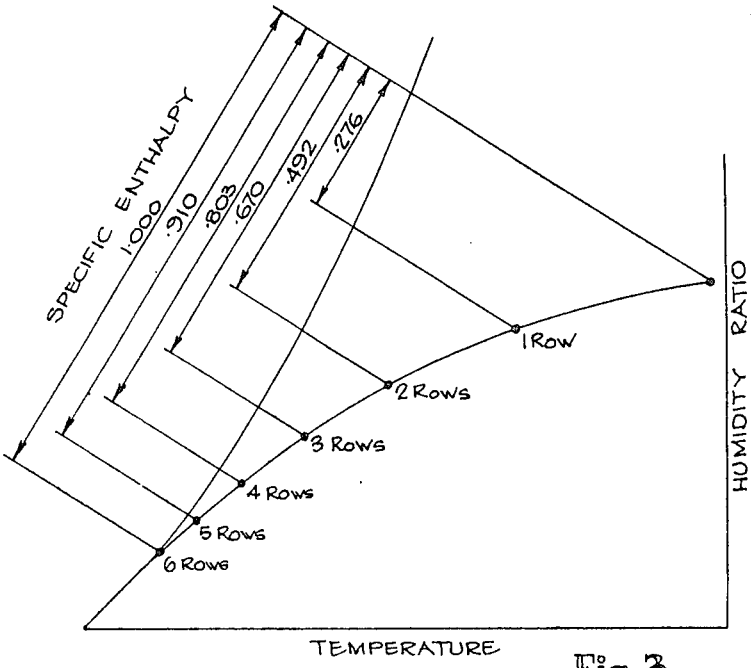
FIG. 3 illustrates the approximate performance characteristics for consecutive rows of coils in a dehumidifier six rows deep.

FIG. 3 illustrates one of the principles under which air conditioning systems now operate, namely for a given coolant temperature, the deeper the coil, the more fins per unit length, the greater the dehumidification. FIG. 3 indicates the enthalpy change for various rows of depth. To follow this principle alone in establishing dehumidifier selection within an air conditioning system can result in large energy losses and poor performance.

The conclusions drawn from a laboratory project under twelve rigid constraints, which serve to eliminate extraneous factors, will be enumerated below. These conclusions were reached using a heat-mass transfer and enthalpy potential theory employing tie line slope relationships. Thus a much more accurate picture of the coil condition curve was obtained than the straight line industrial assumptions of FIG. 1 permit.

A conclusion reached, as a result of a research program conducted by the applicant, is that the shallower the coil, the greater the ratio of dehumidification to cooling when applied to air conditioning system design under the conditions of the twelve constraints.

This is a matter of great importance in energy conservation.

The new principles which have been discovered by the applicant herein have followed a pattern which goes counter to existing practice and demonstrates the importance of viewing the dehumidifier as part of the total air conditioning system for which it is intended.

The failure of existing practice to recognize these new principles of air conditioning as set out herein has led to arbitrary selection by designers of face velocities which are usually high, between 2.03 meters per second (400 feet per minute) and 3.56 meters per second (700 feet per minute). Translated to a psychrometric chart, this has resulted in coil condition curves which are frequently not compatible with the sensible heat ratio.

In those cases where there is a re-heat by the application of further energy, the over-cooling beyond the sensible heat required to off-set latent heat, and the re-heating constitutes a "double penalty" of energy, that is twice the energy required for over cooling when the coefficient of performance of the cooling apparatus is as low as unity. It is usually about three, and can exceed five, and the energy required for reheating then exceeds the energy required for overcooling. The requirement for over cooling also requires the use of larger cooling towers and larger refrigerating machinery. These are relatively expensive elements of an air conditioning installation, and the cooling tower is bulky when compared with the heat exchanger coil. They are also relatively expensive elements of an air conditioning installation and compared with them the extra cost of a larger face area heat exchanger coil is relatively small.

The principles which have been enunciated heretofore in textbooks have resulted in the use (as said above) of relatively high velocities of air over the heat exchanger coils, and consequently relatively high Reynolds numbers, when compared with the principles of this invention. For the purposes of this specification the Reynolds number is identified by the following equation:

$$Re = D_e G_m / \mu$$

where:

$D_e$ is the equivalent hydraulic diameter of the compact heat exchange surface used as a dehumidifier.

$G_m$ is the mass velocity of air per unit area, and $\mu$ is the viscosity of the fluid (air).

(note that there are other Reynolds numbers which are not relevant).

Heretofore Reynolds numbers for supply air, when passing over a dehumidifier, have ranged from 300 to 5000 (and above). In this invention the Reynolds numbers range from 100 to 2000. Any possible overlap in the Reynolds number range is due to the differences in equivalent diameters for different coil geometries. In all cases the Reynolds number is lower in this new method when the same geometries are compared. Reynolds number in the air conditioning range is equal to a constant multiplied by the face velocity. Thus Reynolds number according to this invention is equal to the Reynolds number as would be used in existing practice multiplied by the ratio of face velocity as determined by this invention to the face velocity of existing practice.

For many conditions to be satisfied, it is often necessary for the coil condition curve to have a steeper slope and less curvature than curves which have been used in prior art machines. In this regard it should be pointed out that some charts (as is the case for FIG. 1) oversimplify the coil condition curve shape by showing it to be straight, whereas such a shaped curve would be impossible to achieve, and the curvature is quite considerable at the relatively high air rates which have been previously used (two meters per second, i.e. 400 feet per minute, or more).

Coil condition curves approaching that of a straight line, and having a steep slope, are achieved in this invention by using face velocities of air and Reynolds numbers for coil complex which are much lower than heretofore, and consequently the face area of the coil is larger than in prior art installations, the coil is shallower and the air velocity much less. Although this will result in a larger cross-sectional space to be occupied by the coil and consequently there might need to be a change of configuration in the "fan room", the power required for driving the air over the coils will be reduced, the expensive refrigeration equipment will be smaller, and the cooling tower requirements less. The latter is usually located on top of a high building, and considerable savings can be obtained due to reduced space and weight. The overall effect therefore is not necessarily an increase in space as would have been expected, but frequently the use of less space than has been used heretofore, lower capital cost and reduced energy consumption.

FIG. 4 illustrates three coils 10, 11 and 12 which were used in a comparative analysis which was made to exemplify the invention. These were the three dehumidifier coils for which the family of curves of FIG. 2 were determined. Each of the three coil condition curves were developed fully from arbitrary entry condition to the final surface temperature of the most downstream increment of wetted surface area in the direction of air flow.

It is possible from FIG. 2 to indicate the condition of the air stream in its passage through the coil by locating along each curve the number of rows in depth that apply.

The three curves were defined through twelve constraints that form the basis of comparison in order to carry out this study in a manner which would eliminate irrelevant factors that could interact with the investigation.

Basis of Comparison—a study of the three coils appropriate to air conditioning applications was made. The basis for comparison is listed in the form of twelve constraints. FIG. 4 illustrates the coil arrangements being compared:

1. All have the same primary surface area, tube diameter, wall thickness and material.
2. All have the same secondary fin surface area, diameter, wall thickness and material.
3. All have equal heat exchange surfaces that are geometrically identical.
4. All are compared under conditions of the same mass flow of air, specific enthalpy, dry bulb temperature, humidity ratio at inlet to the coil.
5. Coil 12 has twice the face area of datum coil 10.
6. Coil 11 has half the face area of datum coil 10.
7. All have the same refrigerant condenser pressure (But of course this will not apply directly to chilled water or brine systems).
8. All have the same refrigerant evaporator pressure (or coolant temperature).
9. All have the same dryness fraction at inlet to the evaporator for the same inlet conditions if a chilled water or brine coil is used.
10. All have the same superheat condition leaving the evaporator (This will not apply directly to chilled water or brine systems).
11. All evaporator (or coolant) surfaces are completely wetted.
12. The refrigeration (cooling) capacity and mass flow of the refrigerant (coolant) were varied to be compatible with constraints 7 to 10 inclusive.

The resulting tie line slopes are consistent with:

(1) the same primary surface area constraint (2) the same secondary fin surface area constraint (3) the equal heat exchange surface area of constraint (4) the doubling and halving of face areas of constraints.

However, the above constraints identify only particular points of depth being compared on a basis of different air velocities. The comparison is restricted to maintaining a face area consistent with a fixed mass flow rate of air. The tie line slope was determined non-empirically for the particular points of depth of the shallowest and deepest coil through the relationships set up through the 12 constraints with an empirical datum coil. Of course the full coil condition curve represents every possible depth of coil from a single row to an infinity of rows. Once the tie line slopes of the shallowest and deepest coil were determined for the particular points of comparison, the above enumerated constraints no longer applied and it was then possible to develop the full coil condition curves.

The variables affecting the type of dehumidifier coil most suited for air conditioning application are numerous. Apart from the major findings relating the slope and curvature of the coil condition curve with that of the face velocity and Reynolds number of the air stream, the variables included:

(a) the temperature of the coolant,
(b) the depth of the coil,
(c) the geometry of the coil including the ratio of outside to inside surface,
(d) the operating set point,
(e) the dew point temperature of the operating set point, and
(f) the temperature difference across the dehumidifier coil.

With the exception of the geometry of the coil, which is consistent for every family of curves chart, the parameters listed directly above can be depicted on a psychrometric chart. As such given the charts covering various coil designs for a particular inlet condition, the required coil is readily identifiable. On identifying the required coil condition curve, the following information becomes available, that is, coil size, face area and rows of depth.

From the same chart, if marked with the tie line slope construction lines, the log mean specific enthalpy and the log mean surface temperature can be calculated.

A family of coil condition curves will be associated with the following common properties:

1. The identical type of extended surface heat exchanger having the same general pattern, tube spacing, tube arrangement fins per unit length of tube, secondary fin to the primary tube surface area, tube diameter, wall thickness and material,
2. The same intensive property of air, specific enthalpy, dry bulb temperature and humidity ratio at inlet to the dehumidifier,
3. If it is a direct expansion coil, all members of the family will have the same refrigerant condenser pressure.
4. If it is a direct expansion coil, all will have the same refrigerant evaporative pressure, or if a brine or chilled water coil, the same coolant temperatures,
5. If it is a direct expansion coil, all will have the same dryness fraction at inlet to the evaporator,
6. If it is a direct expansion coil, all will have the same superheat condition leaving the evaporator.
7. All evaporator or coolant surfaces will be completely wetted.
8. All will have face areas that will result in the same mass flow of air.

Each family of coil condition curves differs from each other family due to the face velocity and Reynolds number of the coil complex.

For simplicity's sake, only three curves are shown on FIG. 2 but any number of curves can be developed. However, the curvature and slope of all other curves would be located between the maximum and minimum face velocity curves, progressively having decreasing curvature and increasing slope as face velocity is decreased.

It is to be noted that on examining these three curves after they have been marked to include an indication of the number of rows of depth along the curve, for the same amount of humidity ratio change, the number of rows in depth required is decreased as face velocity is decreased, the following tabulated relationship can be observed from Table 2.

Tables 2 and 3 present a means to assess the 3 performance curves of FIG. 2 as drawn on a psychrometric chart. The uppermost curve has been selected according to "good" engineering practice at approximately 2 meters per second. The middle curve has been selected at a face velocity of 0.92 meters per second and the lowest curve at a face velocity of 0.46 meters per second according to the principles of this invention. The middle curve, a 4 row deep coil was selected to satisfy the requirement of 11.8 C dry bulb temperature and 0.0074 humidity ratio at outlet of the dehumidifier. The lowest curve, a 2 row deep coil was selected to satisfy the requirement of 12.8 C dry bulb temperature and 0.0074 humidity ratio. The uppermost curve, a 6 row deep coil would have been the solution to both problems had it been selected according to "good" engineering practice.

For these two problems, the selection of a dehumidifier performing according to the uppermost curve would result in over-cooling of the airstream in order to effect sufficient dehumidification and furthermore there would be either the need for the addition of either waste heat or inclusion of another energy penalty in the form of reheat to obtain the required outlet conditions.

TABLE 2

Family of curves Assessment for the same amount of humidity ratio change.

RUN 1 (with entering specific enthalpy = 42 kJ/kg; entering dry bulb temperature = 19.85° C. evaporator temperature = 4.16° C.

| CURVE NO. | FACE VELOCITY $\frac{m}{s}$ /fpm | SPECIFIC ENTHALPY DIFFERENCE | COIL DEPTH RELATIVITY | TIE LINE SLOPE kJ/kg . C | SLOPE OF COIL CONDITION CURVE RELATIVITY | CURVATURE OF THE COIL CONDITION CURVE, RELATIVITY | BYPASS FACTOR (WET BULB DEPRESSION RATIO) RELATIVITY |
|---|---|---|---|---|---|---|---|
| 1. | 1.84/363 | greatest | greatest | −1.68 | least | greatest | least |
| 2. | 0.92/181 | medium | medium | −2.50 | medium | medium | medium |
| 3. | 0.46/90 | least | least | −3.82 | greatest | least | greatest |

Evaluation of energy savings

The highest and the lowest face velocity coils of run 1 on an experimental University of Adelaide system is hereunder examined from the point of view of evaluating the effect of the variation of face velocity, as for example through the use of a family of coil condition curve chart in selecting a dehumidifier.

For this purpose three design problems are hereunder solved.

In each problem the entering condition to a particular dehumidifier will be the same, thus one single chart will suffice. The common entering condition and the three different desired leaving conditions are tabulated below.

| | | | |
|---|---|---|---|
| Entering condition: | specific humidity 42.0 kJ/kg<br>dry bulb temperature 19.85C<br>humidity ratio 0.0086 | | |
| Desired leaving conditions: | Problem 1 | Problem 2 | Problem 3 |
| Specific humidity | 39.1 kJ/kg | 33.78 kJ/kg | 25.5 kJ/kg |
| Dry bulb temperature | 17.85 | 14.30 | 8.85 |
| Humidity ratio | 0.00830 | 0.00763 | 0.00652 |
| COIL 1<br>FACE VELOCITY | 0.46 meters/second (90.5 feet/minute) | | |
| COIL 2<br>FACE VELOCITY | 1.84 meters/second (363.0 feet/minute) | | |

It is to be noted that the face velocity of coil 2 is just below the minimum conventionally used in air conditioning practice and that the face velocity of coil number 1 is one fourth of this value. Both coils have the same mass flow of air. In each problem the coil condition curve of the lower face velocity coil passes directly through the desired leaving condition. In each case the higher face velocity coil must overcool in order to sufficiently dehumidify. In each case the higher velocity coil will be considered to reheat the air to reach the design condition. The problem is to determine the percent of energy wasted by using the higher face velocity coil rather than the lower face velocity coil. Since the higher face velocity coil is at a velocity below the minimum conventionally used in air conditioning practice, the energy wasted by existing systems as determined by these problems will always be greater than the problem solutions. This clearly indicates the enormous savings gained by the use of this invention when compared to prior art. See FIG. 5.

Problem 1 is a type of problem encountered in climate simulation where only 2° C. is the permissible gradient across the conditioned space e.g. phytotron unit.

Energy waste in overcooling and reheating =

$$2 \times \frac{\Delta H \text{ RE EXCESS COOLING}}{\Delta H \text{ NECESSARY COOLING}} = \frac{(2)(39.1 - 37.8)}{42.0 - 39.1} = 93\%$$

(N.B. the multiplier 2, appearing in all problem solutions covers both overcooling and reheating).

Problem 2 A medium temperature difference across coil.

Energy waste = 2 ×

$$\frac{\Delta H \text{ RE EXCESS COOLING}}{\Delta H \text{ RE NECESSARY COOLING}} = \frac{2(33.8 - 32.0)}{42.0 - 33.8} = 43\%$$

Problem 3 A conventional air conditioning application with 11° C. temperature difference across the coil and leaving condition very near saturation.

Energy waste = 2 ×

-continued $$\frac{\Delta H \text{ RE EXCESS COOLING}}{\Delta H \text{ RE NECESSARY COOLING}} = 2 \times \frac{(25.5 - 24.1)}{42.0 - 25.5} = 17\%$$

(note that the above calculations for reheating assume a Coefficient of Performance of unity. It usually exceeds unity, and therefore the energy waste will usually exceed the figures shown. For example, with an electrically driven compressor and an electric reheater, the multiplying factor would be four, not two, for coefficient of performance of three).

Comment on problems

These problems highlight the different order of face velocities that are recommended by use of this invention.

Run 1 presents a common problem encountered in the field of air conditioning, yet as can be seen from the results very substantial energy savings in operating costs would be realised if the dehumidifier were selected for a very low unconventional face velocity of 0.5 meters per second. This is considered to be the minimum face velocity in this invention because of the cost involved in building excessively large structures for lower velocities.

It is interesting to note that the three coil condition curves of run 1 do not appear to be very different from each other. Yet the large energy savings are based on them.

Figure 5:
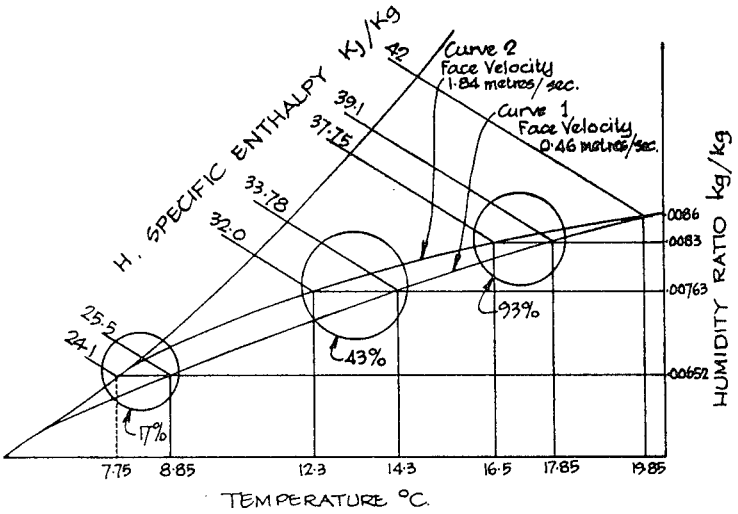
FIG. 5 shows graphically the relationship between face velocity and operating costs.

FIG. 5 is a duplication of the 2 extreme curves of FIG. 2 indicating all the values used in the 3 problems worked above.

Part Load Conditions

This new method of air conditioning is very suited for conservation of energy and improving performance for part load conditions.

In air conditioning practice one of the most common arrangements when chilled water coils are employed is to bypass chilled water around the coil as a means of maintaining the desired conditions in the air conditioned space during part load operation. The air flow rate remains constant.

This existing practice frequently goes counter to the change in air conditioning load characteristics during part load performance. During marginal weather the transmission sensible heat loads will reduce or actually become negative and cancel part of the internal sensible heat loads. However, the latent heat loads from people and infiltration will remain the same. The result is a reduced sensible heat ratio during part load conditions. To offset the sensible and latent heat loads for such a condition the coil condition curve should become steeper, that is it should have a larger negative tie line slope. As will be shown, it becomes shallower. As a consequence either the space conditions are not maintained or a system such as is commonly used employing wasteful overcooling accompanied by wasteful reheating may result.

In a comparison between full load and part load conditions it is desired to determine the tie line slope. (Though an evaporator is investigated the principles that are developed here are applicable to brine and chilled water coils).

The Bo Perre Equation for an evaporator will be used to solve this problem.

$$h_{R(avg)} = \frac{0.0082k_\phi}{d}\left[\left(\frac{G_R d}{\mu\phi}\right)^2\left(\frac{J\Delta \times H_{fg}}{L}\right)\right]^{0.4}$$

where $h_R$=refrigerant heat transfer coefficient.

$h_{i(avg)}$=combined heat transfer coefficient for refrigerant through water layer, metal and inside surface.

$K\phi$=thermal conductivity $G_R$=mass velocity of refrigerant d=diameter of tube $\mu\phi$=absolute viscosity J=mechanical equivalent of heat $\Delta x$=vapour fraction $H_{fg}$=latent heat of vapourisation L=length of tubing Run 1 of the datum coil which is found to have a tie line slope of −2.5 KJ/KgC is compared with the same run under 61.1 percent part load conditions. Assume the refrigerant flow is regulated and that the air flow rate remains the same as per full load conditions.

The relevant portion of the Bo Perre Equation is:

$$\Delta h_{R(avg)} \approx \Delta h_{i(avg)} = [(G_R)^2]\cdot{}^{.4} \longrightarrow \Delta h_i = [(.611)^2]\cdot{}^{.4} = 0.674$$

(TIE LINE SLOPE) = ($\Delta h_i$) (TIE LINE SLOPE)
(PART LOAD) (FULL LOAD)

TIE LINE SLOPE = (0.674)(−2.5) = −1.69
(PART LOAD)

Compare this with TIE LINE SLOPE = −2.5
(FULL LOAD)

Obviously, under the conditions of this problem which follows existing practice during part load conditions the reduced negative tie line slope will result in a shallower coil condition curve just when a steeper slope is often required. The system will either have to be overcooled and possibly reheated or the performance reduced. In many cases the uncomfortable humid feeling experienced during part load conditions can be attributed to the failure of existing systems to accommodate part load conditions.

By application of this invention, reduction in the air flow rate across the dehumidifier proportionally with the drop in full load and the system coil condition curve changes the family of curves to a steeper slope. Both energy savings and greater comfort result.

In areas where lower sensible heat ratios characterise part load operations and where part load operations occur frequently it may be recommended to use a coil condition curve during full load operation which has a higher negative tie line slope than is necessary, though resulting in an acceptable effective temperature. Thus part load conditions are further improved.

TIE LINE SLOPE

Improved mass transfer to heat transfer at reduced air velocities is reflected in the decreasing Tie Line Slope. The Tie Line Slope equation is:

$$\frac{H_s - H}{t_s - t_r} = -\frac{H_i A_i}{0.9\, h_{do} A_o}$$

where:

$H_s$ is Enthalpy of saturated air at water film temperature, in kJ per kg.

H is Specific enthalpy of air in kJ per kg.

$t_s$ is temperature of saturated moist air (°C.).

$t_r$ is refrigerant temperature $h_i$ is combined coefficient of heat transfer through water layer, metal and refrigerant film W per $m^2$(°K.)

$A_i$ is inside refrigerant pipe area in square m.

$A_o$ is total outside surface area, being the sum of primary pipe and fin surface areas in square m.

$h_{do}$ is mass transfer coefficient for outside surface kg per (S) ($m^2$)

The value of $h_{do}$ referred to above was determined from the dimensionless complex:

$$S_t P_r^{\frac{2}{3}}$$

($S_t$ is the Stanton number and $P_r$ is the Prandtl number) which is a function of the Reynolds number as herein determined.

Thus the improved mass transfer to heat transfer is related to the ratio of $h_i$ to $h_{do}$.

Table 3 indicates the effect of decreasing the face velocity of the deepest coil 11 in 2 steps, first by half to that of the datum coil 10 and then the datum coil 10 by half again to the shallowest coil 12 (FIG. 4). Associated with this decrease of face velocity, $h_i$ decreased by only 13% in step 1 and 13% in step 2. On the other hand the value of $h_{do}$ decreased by 42% in step 1 and by 43% in step 2. It is this relationship that is responsible for the significant reduction in Tie Line Slope and the related increase in ratio from simultaneous mass transfer to heat transfer with the reduction of face velocity.

TABLE 3

| FIG. 4 | Face Velocity m/s | $h_i$ W/$m^2$K | $h_{do}$ kg/$sm^2$ | $\frac{h_i}{h_{do}}$ $\frac{kWs}{kgK}$ | Tie Line Slope $\frac{kJ}{kgK}$ |
|---|---|---|---|---|---|
| Deepest Coil 11 | 1.84 | $1.69 \times 10^3$ | 0.0848 | 19.9 | −1.7 |
| Datum Coil 10 | 0.92 | $1.47 \times 10^3$ | 0.0494 | 29.8 | −2.5 |
| Shallowest Coil 12 | 0.46 | $1.28 \times 10^3$ | 0.0283 | 45.2 | −3.7 |

TABLE 3: GREATER DECREASE IN $h_{do}$ OVER $h_i$ RELATED TO IMPROVED RATIO OF $\frac{h_i}{h_{do}}$ WITH DECREASE OF FACE VELOCITY

Figure 6:
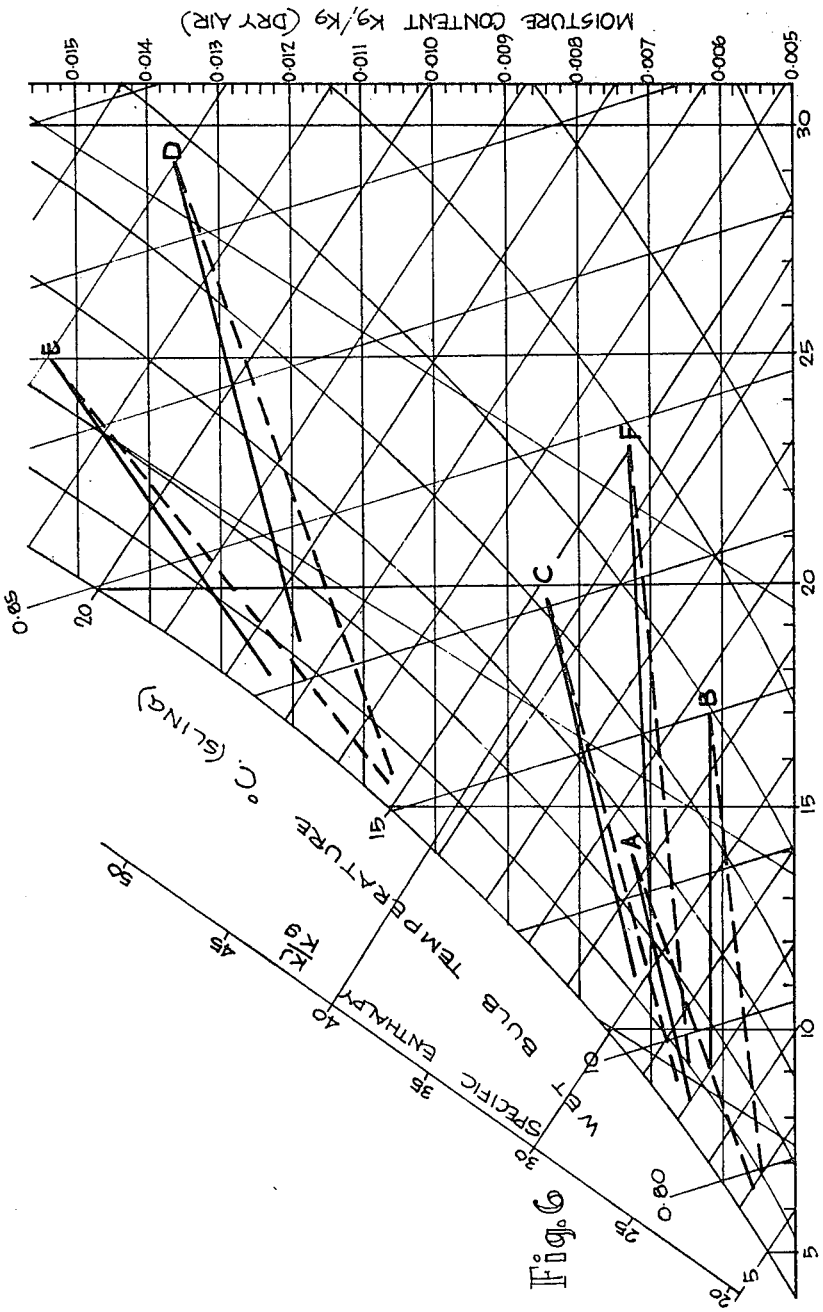
FIG. 6 shows portion of a psychrometric chart bearing results of confirmatory tests which were undertaken, but being a simplified diagram wherein inlet and outlet conditions are interconnected by straight lines.

The confirming Tests (FIG. 6)

The confirming tests cover two independent research projects. However, the entry conditions and constraints were so selected as to closely inter-relate the two projects so as to link the verification to the basic theory. Both projects studied the performance of six pairs of different entry conditions to the dehumidifier. In the first of the projects one member of each pair had twice the velocity of the other.

The following properties were kept constant for each member of the six pairs of runs considered in Project 1:

dryness fraction at entry to evaporator
superheat condition leaving evaporation
entry dry bulb temperature
entry wet bulb temperature
evaporator pressure
condenser pressure The face velocity of one member of the pair was twice that of the other member of the pair.

The performance data of the six pairs are listed in Table 5. The entry and leaving conditions are connected by a straight line on the psychrometric chart of FIG. 6. The full lines represent the higher velocity runs and the dotted lines represent the lower velocity runs.

The actual path of the coil condition curve obtained by using Tie Line Slope construction lines would be similar to the curves of FIG. 2. Table 4 identifies each member of Project 1.

TABLE 4

| COIL CONDITION CURVES FOR RUNS A TO F OF PROJECT 1 | | |
|---|---|---|
| | IDENTIFICATION OF EACH MEMBER OF PAIR | |
| PAIR NUMBER | HIGH VELOCITY MEMBER (HV) | LOW VELOCITY MEMBER (LV) |
| 1 | A - HV | A - LV |
| 2 | B - HV | B - LV |
| 3 | C - HV | C - LV |
| 4 | D - HV | D - LV |
| 5 | E - HV | E - LV |
| 6 | F - HV | F - LV |

TABLE 6-continued

| IDENTIFICATION OF TEST PAIRS OF PROJECT 2 | |
|---|---|
| PAIR | RUN |
| 2 | B - HV<br>A - LV<br>with<br>B - LV |
| 3 | C - HV<br>with<br>F - HV |
| 4 | C - LV<br>with<br>F - LV |
| 5 | D - HV<br>with<br>E - HV |
| 6 | D - LV<br>with<br>E - LV |

NOTES:
(1)Curves A to E identified on FIG. 6.
(2)High Velocity = HV
(3)Low Velocity = LV

TABLE 5

PERFORMANCE DATA OF SIX PAIRS OF TEST RUNS OF PROJECT 1
A study of the effect of variation of air velocity across a dehumidifier coil

| PROPERTY VARIED FOR MEMBERS OF EACH PAIR | PROPERTIES MAINTAINED CONSTANT FOR MEMBERS OF EACH PAIR OF TEST RUNS | | | | | | | LEAVING CONDITIONS | | |
|---|---|---|---|---|---|---|---|---|---|---|
| RUN | Face Velocity m/s | $eh_a$ kJ/kg | edbt C | ewbt C | Evaporator Pressure kPa gauge | Condenser Pressure kPa gauge | Dryness Fraction at Entry to Evaporator | Superheat Leaving Evaporator C | dbt C | wbt C | w g/kg |
| A - HV | 1.86 | | | | | | | | 8.5 | 8.0 | 6.5 |
| A - LV | 0.93 | 32.8 | 14.0 | 11.4 | 200 | 875 | 0.22 | 5.3 | 6.5 | 6.0 | 5.6 |
| B - HV | 1.86 | | | | | | | | 9.2 | 8.0 | 6.2 |
| B - LV | 0.93 | 32.8 | 17.0 | 11.6 | 200 | 875 | 0.22 | 5.3 | 6.7 | 6.0 | 5.5 |
| C - HV | 1.36 | | | | | | | | 11.3 | 10.1 | 7.0 |
| C - LV | 0.68 | 41.5 | 19.7 | 14.8 | 230 | 975 | 0.20 | 4.7 | 9.0 | 8.4 | 6.7 |
| D - HV | 1.71 | | | | | | | | 18.8 | 17.4 | 11.9 |
| D - LV | 0.86 | 64.0 | 29.2 | 22.0 | 295 | 960 | 0.20 | 5.8 | 15.8 | 15.3 | 10.7 |
| E - HV | 1.71 | | | | | | | | 18.0 | 17.5 | 12.3 |
| E - LV | 0.86 | 64.0 | 25.7 | 21.9 | 295 | 960 | 0.20 | 5.8 | 15.6 | 15.3 | 10.7 |
| F - HV | 1.36 | | | | | | | | 11.8 | 10.2 | 7.0 |
| F - LV | 0.68 | 41.5 | 23.0 | 15.0 | 230 | 975 | 0.20 | 4.7 | 8.8 | 8.2 | 6.5 |

The change in humidity ratio across the dehumidifier may be compared with the value of the ratio of rate of water condensed at the dehumidifier to the flow rate of dry air obtained from the pressure reading at a Venturi tube. It was found that these two ratios agreed within a tolerance equivalent to ±0.1C on Assmann readings.

The second project studied dehumidifier coil performance in relation to enthalpy potential theory:

The following properties were kept constant for each member of the six pairs of runs considered in these confirming tests:

air flow rate
condensing temperature
evaporator temperature
superheat condition leaving evaporator
dryness fraction entering evaporator
entering air enthalpy.

The dry bulb temperature of each member of a pair was different. The entry and leaving conditions, connected by straight lines, share the same FIG. 6. The six pairs that make up this study are listed in Table 6 with the run letter identifying each member of the pair.

TABLE 6

| IDENTIFICATION OF TEST PAIRS OF PROJECT 2 | |
|---|---|
| PAIR | RUN |
| 1 | A - HV<br>with |

An examination of the performance data for the six pairs of test runs associated with a second Research project, Table 7, and the lines connecting the entry and leaving conditions for each pair, FIG. 6, reveal that for both high and low velocity runs, for dry, part wetted and fully wetted performance of the coil, each pair of coils started with the same entry enthalpy condition and ended with the same leaving enthalpy condition. This confirms the enthalpy potential theory for all runs examined including the ones that exhibited heat transfer only. In the case of Run 4 HV, compared with dry Run 7 HV there was a deviation of 0.2 C. There was also a deviation of 0.2 C when Run 4 LV was compared with Run 6 LV. All other pairs tested for adherence to enthalpy potential theory agreed with ±0.5 C which is well within the resolution capability of the instruments and imperfections in the total system steadyflow operation. This included Run 2 HV compared with dry Run 3 HV.

Enthalpy potential is concerned with the difference between the enthalpy of unsaturated air and the enthalpy of air at the temperature of a wetted surface, yet for High Velocity Run 3 the leaving enthalpy for this dry run is, within reading accuracy, that of High Velocity Run 2 which has a completely wetted surface. It is to be noted that High Velocity Dry Run 7 is at a lower face velocity than High Velocity Dry Run 3.

TABLE 7

PERFORMANCE DATA OF SIX PAIRS OF TEST RUNS OF PROJECT 2
A study of dehumidifier performance in relation to enthalpy potential theory

| | PROPERTIES VARIED FOR MEMBERS OF EACH PAIR | | PROPERTIES MAINTAINED CONSTANT FOR MEMBERS OF EACH PAIR OF TEST RUNS | | | | | | LEAVING CONDITIONS | | |
|---|---|---|---|---|---|---|---|---|---|---|---|
| RUN | edbt C | ewbt C | Face Velocity m/s | Evaporator Pressure kPa gauge | Condenser Pressure kPa gauge | Dryness Fraction at Entry to Evaporator | Superheat Leaving Evaporator C | $eh_a$ kJ/kg | $h_a$ kJ/kg | dbt C | wbt C |
| A - HV | 14.0 | 11.4 | | | | | | | | 8.5 | 8.0 |
| B - HV | 17.0 | 11.6 | 1.86 | 200. | 875. | 0.22 | 5.3 | 32.8 | 24.9 | 9.2 | 8.0 |
| C - HV | 19.7 | 14.8 | | | | | | | | 11.3 | 10.1 |
| F - HV | 23.0 | 15.0 | 1.36 | 230. | 975 | 0.20 | 4.7 | 41.5 | 30.2 | 11.8 | 10.2 |
| E - HV | 25.7 | 21.9 | | | | | | | 49.5 | 18.0 | 17.5 |
| D - HV | 29.2 | 22.0 | 1.71 | 295 | 960 | 0.20 | 5.8 | 64.0 | (±0.10) | 18.8 | 17.4 |
| A - LV | 14.0 | 11.4 | | | | | | | | 6.5 | 6.0 |
| B - LV | 17.0 | 11.6 | 0.93 | 200 | 875 | 0.22 | 5.3 | 32.8 | 20.7 | 6.7 | 6.0 |
| C - LV | 19.7 | 14.8 | | | | | | | 25.7 | 9.0 | 8.4 |
| F - LV | 23.0 | 15.0 | 0.68 | 230 | 975 | 0.20 | 4.7 | 41.5 | (±0.15) | 8.8 | 8.2 |
| E - LV | 25.7 | 21.9 | | | | | | | 43.0 | 15.6 | 15.3 |
| D - LV | 29.2 | 22.0 | 0.86 | 295 | 960 | 0.20 | 5.8 | 64.0 | (±0.05) | 15.8 | 15.3 |

The two projects are related in that every member of each pair of runs was a member of both projects. Consequently if the performance of the second project is accepted to adhere to enthalpy potential theory so too must the performance of the first project.

All the research data presented above are repeatable. Many of the tests were performed twice.

The research system has been demonstrated to have the capacity to maintain six properties constant under conditions where a seventh property is varied, a necessary requirement is to conduct both Projects.

The second Project yields results consistent with enthalpy potential theory.

Since the individual test runs of Project I are identical with those of Project II, it follows that the test results of the first Project are also consistent with enthalpy potential theory and hence may be judged to be reliable.

A consideration of the above embodiments will reveal the following:

1. Air stream velocity and Reynolds number of the coil complex are two of the major operative factors in determining the coil condition curve of a dehumidifier.

2. As the velocity of an air stream and the Reynolds number over a dehumidifier surface varies from high to low so does the slope of the coil condition curve vary from shallow to deep.

3. As the velocity of an air stream and the Reynolds number over a dehumidifier surface varies from high to low so does the curvature of the coil condition curve vary from a considerable curvature towards that of a straight line.

4. The assumed straight line characteristic of coil condition curves historically used in industrial methods as described above does not hold for the range of air velocities employed in air conditioning applications, (3.5 meters per second (700 feet per minute) down to 2 meters per second (400 feet per minute)).

5. Conventional design approach used in air conditioning and climate simulation can result in large energy penalties and failure to attain desired conditions for full load and/or part load operation when dehumidification is required.

6. Conventional design approach towards special arrangements where dehumidification is required must be re-examined in the light of energy savings due to reduced cooling and heating, reduced fan power, reduced size of refrigeration equipment and cooling tower, their piping, conduit and accessories and their reduced weights and costs.

7. From an examination of part load conditions frequently present in conventional air conditioning applications there is a strong case pointing to the use of variable air flow rates varying proportionally with the size of the loads.

8. From an analysis of dehumidifier performance a new method of air conditioning has been derived.

9. By application of this invention, the coil condition curve is more compatible with the load ratio line, and maximum energy conservation is obtainable.

10. In an air conditioning complex running costs may far outweigh initial costs as a criterion.

11. In determining dehumidifier design for air conditioning application, a new system is recommended with the face velocities different and with the coil surfaces characterised by a lower range of Reynolds number than presently used in existing air conditioning practice.

Various modifications in structure and/or function may be made to the disclosed embodiments by one skilled in the art without departing from the scope of the invention as defined by the claims.

I claim:

1. A method of conditioning air in a space to maintain a design condition of temperature and humidity of the air within that space by removal of sensible and latent heat from supply air by passing said supply air through a heat exchanger functioning as a dehumidifier, said method comprising:

reducing specific enthalpy by passing said supply air over relatively cold heat exchange surfaces of said dehumidifier and so arranging the face velocity of the air at entry to the dehumidifier to lie between 0.4 and 2 meters per second, the equivalent hydraulic diameter of the compact heat exchanger surface of the heat exchanger ($D_e$) and the mass velocity of air per unit are ($G_m$) being such that the maximum Reynolds number of the supply air ($D_eG_m/\mu$ where $\mu$ is the viscosity of the supply air) during its passage over the heat exchanger surface is between 100 and 2000, and maintaining said design condition without reheat but solely by said supply air.

2. A method of conditioning air in a space to maintain a design condition of temperature and humidity of the air within that space by removal of sensible and latent heat from supply air by passing said supply air through a heat exchanger coil functioning as a dehumidifier, said method comprising:

effecting removal of sensible and latent heat solely by passing the supply air through a dehumidifier heat exchanger coil at a face velocity of between 0.4 and 2 meters per second, the equivalent hydraulic diameter of the compact heat exchange surface of the heat exchanger ($D_e$) and the mass velocity of the air per unit area ($G_m$) being such that the Reynolds number of the supply air ($D_eG_m/\mu$ (where $\mu$ is the viscosity of the supply air) during its passage over the heat exchanger surface is between 100 and 2000, said coil having such face area that outlet air of a coil of equivalent face but infinite depth would be saturated with moisture.

3. A method of conditioning air in a space to maintain a design condition of temperature and humidity of the air within that space by removal of sensible and latent heat from supply air by passing said supply air through a heat exchanger functioning as a dehumidifier, said method comprising:

effecting removal of sensible and latent heat solely by passing the supply air through a dehumidifier heat exchanger coil which has sufficient face area that the face velocity is between 0.4 and 2 meters per second, the equivalent hydraulic diameter of the compact heat exchange surface of the heat exchanger ($D_e$) and the mass velocity of the air per unit area ($G_m$) being such that the Reynolds number of the supply air ($D_eG_m/\mu$ (where $\mu$ is the viscosity of the supply air) during its passage over the heat exchanger surface is between 100 and 2000, said face area of said coil being such that a continuation of the coil condition curve on a psychrometric chart will intersect the saturation line of that chart.

4. A method according to claim 2 or claim 3 wherein supply air, after having been cooled, to offset a design condition is not subject to reheating to maintain that design condition.

5. A method of conditioning air in a space to maintain a condition of temperature and humidity of the air according to claim 2 or claim 3 comprising:

effecting the reduction of specific enthalpy solely by passing the supply air over a cooling coil at a face velocity of between 0.4 and 2 meters per second and a maximum Reynolds number of the supply air during its passage through the coil of between 100 and 2000, and so relating the air flow rate, the cooling coil size and geometry, and the leaving temperature and humidity that the coil condition curve of a psychrometric chart approximates the inlet condition of a corresponding load ratio line.

* * * * *